US005873183A

United States Patent [19]

Posner

[11] Patent Number: 5,873,183

[45] Date of Patent: Feb. 23, 1999

[54] SHOE SECUREMENT APPARATUS WITH LACE AND GROOVE FASTENERS

[75] Inventor: Scott Posner, St. Augustine, Fla.

[73] Assignee: Dan Lynn Industries, Inc., Bridgman, Mich.

[21] Appl. No.: 842,995

[22] Filed: Apr. 25, 1997

[51] Int. Cl.[6] ..... A43C 11/12; A43C 1/02; A43C 7/06; A43B 5/00

[52] U.S. Cl. ..... 36/50.1; 36/50.5; 24/715.3; 24/712

[58] Field of Search ..... 36/50.1, 50.5, 36/1; 24/712.1, 712.4, 713, 713.1, 713.2, 714.6, 712.5, 712.7, 712.9, 713.5, 715.3, 715.4, 715.7, 588, 712

[56] References Cited

U.S. PATENT DOCUMENTS

| | | | |
|---|---|---|---|
| 431,737 | 7/1890 | Bertrand | 36/50.1 |
| 705,817 | 7/1902 | Brown | 24/714.6 |
| 796,258 | 8/1905 | Scott | 36/50.1 |
| 923,860 | 6/1909 | Kroell | 24/712.1 |
| 1,022,808 | 4/1912 | Woods | 36/50.1 |
| 1,507,189 | 12/1924 | Keyes | 24/713.2 |
| 1,982,906 | 10/1934 | Dawes | 24/712.1 |
| 2,113,731 | 2/1938 | Kennedy | 24/712.4 |
| 3,744,105 | 7/1973 | Laurita | 24/712.4 |
| 4,458,373 | 7/1984 | Maslow | 36/50.1 |
| 5,158,428 | 10/1992 | Gessner et al. | 24/712.1 |
| 5,291,671 | 3/1994 | Caberlotto et al. | 36/50.1 |
| 5,349,764 | 9/1994 | Posner . | |
| 5,651,195 | 7/1997 | Clancy | 36/50.1 |

*Primary Examiner*—Paul T. Sewell
*Assistant Examiner*—Anthony Stashick
*Attorney, Agent, or Firm*—Dorn, McEachran, Jambor & Keating

[57] ABSTRACT

A shoe securement apparatus for a shoe employing a lace having opposite ends to interconnect two sides of the shoe. The apparatus includes a fastener plug attached to each of the opposite ends of the lace, a guide formed on each side of the shoe for engaging and directing the lace and a channel formed on each side of the shoe for receiving one end of the lace and its fastener plug. The fastener plug is forcibly engageable with the channel to secure the lace in the channel with the fastener plug being formed of a soft, flexible material such as a polymer. In one embodiment of the invention, the guide in an inclined groove and in another embodiment of the invention the guide is a knob with a curved wall which engages the lace. In yet another embodiment of the invention the lace is formed of a soft, flexible material such as a polymer.

8 Claims, 2 Drawing Sheets

SHOE SECUREMENT APPARATUS WITH LACE AND GROOVE FASTENERS

BACKGROUND OF THE INVENTION

In my prior U.S. Pat. No. 5,349,764, dated Sep. 27, 1994, I disclosed a shoe securement apparatus for securing a shoe to a foot using a lace but without requiring the use of knots, or the like. Instead of knotting a lace, I disclosed a plurality of posts or clips and indentations on a shoe to take up the slack of a lace and secure the shoe to its wearer. The lace is shown in my patent secured to the sides of the shoe with a fastening means formed of interlocking bristle-like materials, such as a hook and loop fastener arrangement. Non-mating materials were provided at the ends of the lace to prevent the ends of the lace from adhering to the fastening means on the sides of the shoe to thereby permit easy release of the lace.

SUMMARY OF THE INVENTION

The present invention provides a shoe securement apparatus for securing a shoe to a foot which permits the wearer to fasten the lace on each shoe by pushing a lace or a lace having fastener plugs on the lace ends into channels formed on the sides of the shoe. The frictional engagement between the lace or the fastener plugs on the ends of the lace and the walls of the channel prevents the lace from sliding along the length of the channel or pulling out of the channel.

One embodiment of the present invention permits the lace ends to be crisscrossed behind the shoe before being fastened in the channels on opposite sides of the shoe.

Another embodiment of the invention permits the fastening of the lace ends in channels on the sides of the shoe without crisscrossing the lace ends behind the shoe.

Still another embodiment of the invention utilizes a lace formed of a strong, flexible polymer which is press fitted into channels on the sides of the shoe.

Yet another embodiment of the invention utilizes fastener plugs on the ends of the lace of this invention which are formed of a strong, flexible material such as a polymer. These plugs are received and held in molded channels located on the sides of the shoe.

My present invention simplifies the construction of the lace holding channels on the sides of the shoe by utilizing notched channels instead of previously disclosed hook and loop fastener arrangement formed in the channels.

My invention also permits the use of a knob as a guide to guide a lace end into a channel without crisscrossing the lace end behind the back of the shoe.

Other objects and advantages of my invention will be shown in the following drawings.

BRIEF DESCRIPTION OF THE DRAWINGS

The invention is illustrated more or less diagrammatically in the following drawings wherein.

DETAILED DESCRIPTION OF THE PREFERRED EMBODIMENTS

Figure 1:
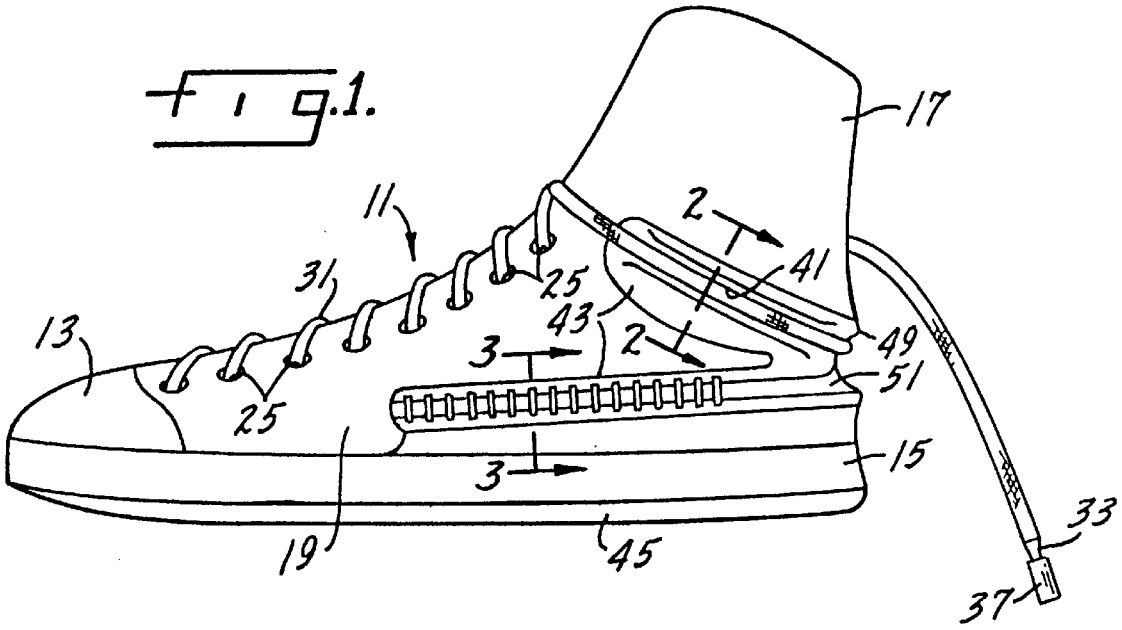
FIG. 1 is a side view of a shoe incorporating one embodiment of the present invention.
Figure 2:
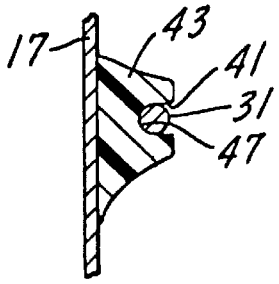
FIG. 2 is an enlarged cross sectional view taken along line 2—2 of FIG. 1.
Figure 3:
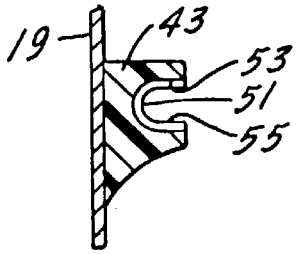
FIG. 3 is an enlarged cross sectional view taken along line 3—3 of FIG. 1.
Figure 4:
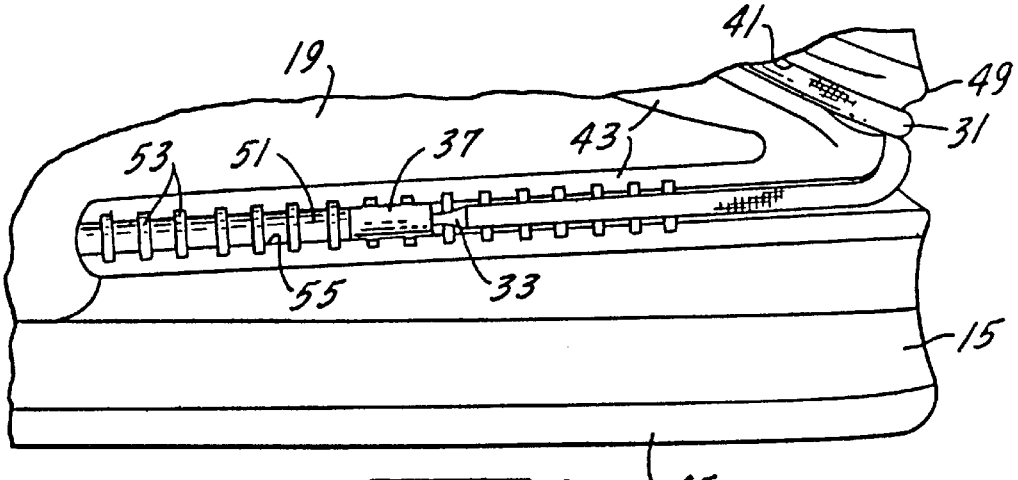
FIG. 4 is an enlarged partial side elevational view showing the insertion of a lace end in the channel of the shoe of FIG. 1.
Figure 5:
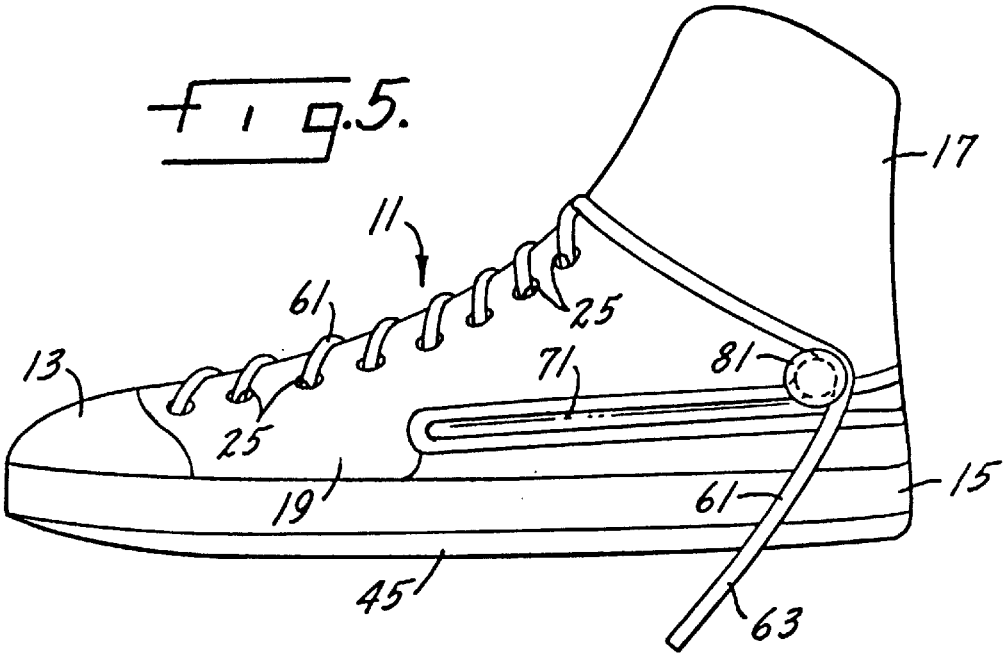
FIG. 5 is a side elevational view of a shoe incorporating an alternative embodiment of the present invention.

As shown in FIGS. 1–4 of the drawings, a shoe 11 made in accordance with one embodiment of the present invention includes a toe 13, a heel 15, an ankle support portion 17, a first side 19 and a second side (not shown in the drawings but a mirror image of the first side). A tongue, which also is not shown, extends along the front of the shoe 11 from the toe 13 to the ankle support portion 17. A series of eyelets 25 extend through the first and second sides of the shoe, all of which is conventional and well known in the shoe manufacturing art. Additionally, a lace 31 having first and second ends 33 are crisscrossed through the eyelets 25 to secure the shoe 11 to a foot. Instead of the conventional metal or plastic ferrule, a plug 37 is attached to each of the ends 33 of the lace 31 and these plugs, which are each cylindrical in shape with a diameter such that each can fit through the eyelets 25, are formed of a soft, flexible material such as a polymer.

A guide in the shape of an inclined groove 41 is formed in a ridge 43 located on the ankle support portion 17 of the shoe. The ridge 43 may be formed of a conventional shoe material and may be attached to the opposite sides of the shoe by conventional shoe manufacturing methods or may be supported on the sole 45 of the shoe and extend upwardly therefrom. It should be understood and appreciated that a ridge is formed on each opposite side of the shoe but that the ridges may also be formed on a single piece of material wrapped around the back of the shoe. Each groove 41 is formed with a smooth curved wall 47 as is shown most clearly in FIG. 2 of the drawings. A lip 49 is formed at the rear of the ridge 43 and is adapted to engage the lace 31 during tightening to prevent vertical movement of the lace up the back of the shoe 11. Also formed as part of each ridge 43 is a generally horizontal channel 51 which is located immediately above the sole 45. Transversely extending notches 53 are formed in the rounded wall 55 of each channel as can be most clearly seen in FIGS. 1, 3 and 4 of the drawings. The ridge 43, the channel 51 and the notches 53 are formed of a harder material than that of which the plug 37 is formed. In the alternative, the ridge 43, the channel 51 and the notches 53 may be formed of a soft, flexible material and the plug may be formed of a harder material.

In use, the first and second ends 33 of the lace 31 are led out of the top eyelets 25 of the shoe on opposite sides of the shoe. Each end of the lace is run through a guide 41 on its side of the shoe, around the back of the shoe where the lip 49 is engaged and then led to the opposite side respectively into a horizontal channel 51. Each plug 37 on a respective end 33 of the lace is force fitted into the horizontal channel 51 with the soft, pliable material of the plug fitting into the transverse notches 53. In this fashion, the shoe can be secured to a foot quickly without the necessity of tying knots in the lace.

Figure 6:
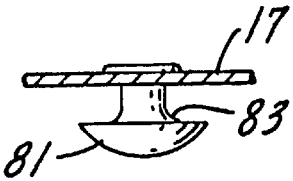
FIG. 6 is an enlarged top plan view of the guide knob shown in FIG. 5.
Figure 7:
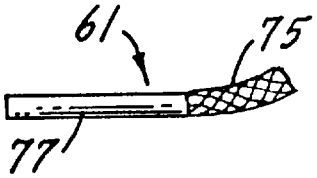
FIG. 7 is an end view of a modified form of a lace of FIG. 5.
Figure 8:
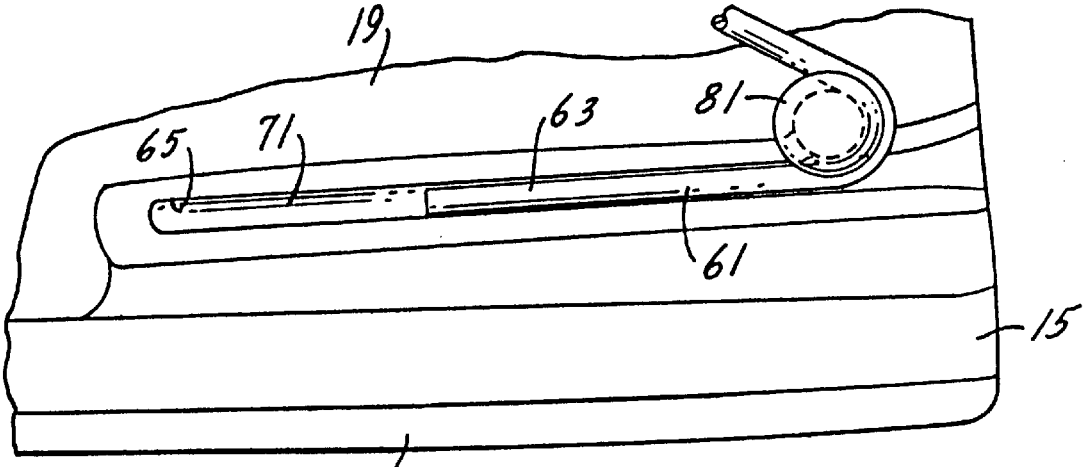
FIG. 8 is an enlarged partial side elevational view of the shoe of FIG. 5 showing the lace secured in the channel.

A second embodiment of my invention is shown in FIGS. 5–8 of the drawings. The shoe 11 with its toe 13, heel 15, ankle support portion 17, first side 19 and second side, which is a mirror image of 19, as well as a tongue which is not shown, and eyelets 25 is identical to the shoe described in the first embodiment of my invention. A lace 61 with first and second ends 63 is utilized in place of the conventional lace 31. In this embodiment of my invention the lace 61 is formed of a soft, flexible material such as a polymer. This lace may be extruded or may be formed of a woven polymer. In addition, as shown in FIG. 7 of the drawings, the lace may be a composite having a woven portion 75 and a non-woven portion 77. As can best be seen in FIG. 8 of the drawings, the lace 61 fits into a horizontal channel 71 equipped with a rounded wall 65 which is sized to snugly receive the lace 61. The material forming the horizontal channel 71 is matched with the polymer of the lace 61 to provide a high friction engagement to hold the lace in the channel.

The modified embodiment of my invention shown in FIGS. 5–8 of the drawings uses as a guide a headed post 81 in lieu of the inclined groove 41 described in connection with the first embodiment of the invention. As shown in FIG. 6 of the drawing, the headed post 81 is fastened to the side wall 17 of the shoe 11 and its use permits the lace 61 to be held in position in the horizontal channel 71 on the side of the shoe without crisscrossing the lace behind the shoe although this guide will also secure a lace that has been crisscrossed behind the shoe as shown in the drawings of the first embodiment of my invention. While the headed post 81 is shown and described as the preferred embodiment of a guide, it should be understood and appreciated that a guide can be made in practically any shape, for example round like a ball or oblong such as a football, so long as the guide is provided with a concave wall restraining the lace such as is provided by lip 83 to keep the lace from slipping off the guide. Additionally, the guide can be any other restraining device such as a piece of cloth, leather or metal shaped like a flat loop in which the lace end 63 would have to be fed through an opening of the loop shaped guide.

The polymer lace 61 heretofore described may also be used with the lace securement means described in connection with the embodiment of FIGS. 1 to 4 of the drawings which incorporate an inclined groove 41 and a generally horizontal channel 51. When a polymer lace 61 is used, it is not necessary to provide a lip such as lip 49 at the rear of the ridge 43 to prevent vertical movement of the lace since vertical movement will be prevented by the frictional engagement of the polymer lace and the side of the shoe. Further, when the opposite ends of the polymer lace are wrapped around the back of the shoe, the provision of a guide such as the inclined groove 41 or the knob 81 are not required.

Various features of the invention have been shown and described in connection with the illustrated embodiments of my invention. However, it must be understood that these particular arrangements merely illustrate, and that my invention is to be given the fullest interpretation within the terms of the appended claims.

I claim:

1. A shoe securement apparatus for a shoe employing a lace having opposite ends to interconnect two sides of said shoe, including:

a fastener plug attached to each of said opposite ends of said lace, a guide formed on at least one side of said shoe for engaging and directing said lace; and a channel formed on at least one side of said shoe for receiving one end of said lace and its fastener plug, said fastener plug being forcibly engageable with said channel to secure said lace in said channel.

2. The shoe securement apparatus of claim 1 in which a guide and a channel are formed on each side of said shoe.

3. The shoe securement apparatus of claim 1 in which said fastener plug is formed of a soft, flexible material and said channel is formed of a harder material.

4. The shoe securement apparatus of claim 1 in which said channel is formed of a soft, flexible material and said fastener plug is formed of a harder material.

5. The shoe attachment apparatus of claim 1 in which transverse notches are formed in said channel.

6. The shoe attachment apparatus of claim 1 in which said guide is an inclined groove.

7. A shoe securement apparatus for a shoe employing a lace having opposite ends to interconnect two sides of said shoe, including, a fastener plug formed of a soft, flexible material attached to each of said opposite ends of said lace, a guide having a curved wall formed on each side of said shoe for engaging and directing said lace; and a channel formed on each side of said shoe for receiving an end of said lace and its fastener plug, each of said fastener plugs being forcibly engageable with its respective channel to secure each end of said lace in a respective channel.

8. The shoe securement apparatus of claim 7 in which transverse notches are formed in said channel.

* * * * *